US005398918A

United States Patent [19]

Rizzolo et al.

[11] Patent Number: 5,398,918

[45] Date of Patent: Mar. 21, 1995

[54] LINEAR MOTION MULTIPLE STAPLING SYSTEM FOR OFFICE MACHINE

[75] Inventors: Charles D. Rizzolo, Rochester; Barry P. Mandel, Fairport; Joseph J. Ferrara, Webster; Anthony T. DeSanctis, Webster; Michael K. Sabocheck, Macedon; Gerald A. Buddendeck, Penfield; Richard A. Van Dongen, Newark, all of N.Y.

[73] Assignee: Xerox Corporation, Stamford, Conn.

[21] Appl. No.: 197,664

[22] Filed: Feb. 17, 1994

Related U.S. Application Data

[63] Continuation of Ser. No. 7,948, Jan. 25, 1993, abandoned.

[51] Int. Cl.[6] ..... B42B 1/02

[52] U.S. Cl. ..... 270/53; 270/58; 355/324

[58] Field of Search ..... 277/53, 58; 355/324

[56] References Cited

U.S. PATENT DOCUMENTS

| | | | |
|---|---|---|---|
| 3,709,595 | 1/1973 | Turner | 355/324 |
| 4,376,529 | 3/1983 | George et al. | 270/53 |
| 4,605,211 | 8/1986 | Sonobe | 270/58 |
| 4,687,191 | 8/1987 | Stemmle | 270/53 |
| 4,886,259 | 12/1989 | Ishikawa et al. | 270/53 |
| 4,925,171 | 5/1990 | Kramer et al. | 270/53 |
| 4,928,941 | 5/1990 | Uto et al. | 270/53 |
| 4,990,967 | 2/1991 | Colglazier | 355/324 |
| 4,993,697 | 2/1991 | Yamashita et al. | 270/53 |
| 5,098,074 | 3/1992 | Mandel et al. | 270/53 |
| 5,114,130 | 5/1992 | Hamanaka et al. | 270/58 |
| 5,150,889 | 9/1992 | Taguchi | 270/53 |
| 5,192,065 | 3/1993 | Hirota et al. | 270/53 |
| 5,253,030 | 10/1993 | Shigemura et al. | 355/324 |

FOREIGN PATENT DOCUMENTS 2173483 10/1986 United Kingdom .

*Primary Examiner*—John T. Kwon

*Attorney, Agent, or Firm*—Fay, Sharpe, Beall, Fagan, Minnich & McKee

[57] ABSTRACT

A stapling apparatus for an office machine includes a housing having a fixed position output providing a sequential source of sheets. An output tray is mounted on the housing adjacent the output for supporting the sheets. A compiler shelf is located on the housing adjacent the output tray. A compiling mechanism is mounted on the housing. A stapler is movably mounted on the housing and is longitudinally reciprocable in relation to the shelf and the compiling mechanism. The stapler and the compiler mechanism are so located in relationship to each other that the stapler has a strictly linear motion along an edge of the sheets.

20 Claims, 9 Drawing Sheets

LINEAR MOTION MULTIPLE STAPLING SYSTEM FOR OFFICE MACHINE

This is a file-wrapper continuation of application Ser. No. 08/007,948, filed on Jan. 25, 1993, now abandoned.

BACKGROUND OF THE INVENTION

This invention relates generally to office machines and specifically to a finishing station of an electrophotographic printing machine. More particularly, the present invention relates to a stapler system of such a machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, it is often desirable to stack the discharged copy sheets, numbering from two sheets up to a large number of sheets, in sets with very close stack registration so as to avoid a ragged or uneven looking stack edge in finished, bound or stapled copy sets. It is further desirable when stapling or binding a set of sheets to so locate or move the stapling or binding device that it can act upon the stack without disturbing the stack registration.

It is known in such office machines to provide a stapler mechanism which staples the registered stack of sheets together. Such staplers can be mounted on a carriage which is moved along one of the edges, the bind edge, of the stack of sheets in order that such stapling can take place. However, in the conventionally known stapler systems associated with a compiler of a copier, the stapler is a separate mechanism that needs to be moved in and out in order to perform the stapling operation. Even in those staplers which are so positioned in relationship to the compiler as to not need a movement of the stapler in order to perform the stapling operation, the stapler if it is moved horizontally along the bind edge of the sheets needs to be moved in and out in order to get around obstacles provided on the machine itself. That is to say, in the known design of a stapler located at the compiler of a copier, the stapler assembly needs to move in two directions, (1) along the bind edge for multiple stapling positions and (2) in an up and back motion in the process direction to move around obstacles or to allow sheet set delivery.

In a very recently introduced product, a linear motion stapler is associated with a sorter device of a copier. In this product, each copy is fed to a different bin of the sorter. When the copying operation is over, the stack of sheets and the sorter tray in each bin is pulled back into the stapler apparatus by a set transport mechanism, is stapled, and is then returned to its bin. The sorter indexes every occupied bin in this fashion. Fixed back walls are secured to the stapler carriage to stop the movement of the set in the process direction. However, this product is a sorter in which the copies are fully supported in bins and not partially supported by a wall of the complier as in a finisher. In addition, in this product, the sheets are not compiled over a portion of the stapler and this would be advantageous to increase the speed with which the machine can operate. Finally, this design requires the use of a separate set transport mechanism as the sheets are not compiled right over the stapler.

Accordingly, it has been considered desirable to develop a new and improved stapler system for the single tray finishing station of an office machine which system would have a strictly linear motion and thereby overcome the foregoing difficulties and others while providing better and more advantageous overall results.

BRIEF SUMMARY OF THE INVENTION

In accordance with the present invention, a new and improved compiling and stapling apparatus is provided for an office machine.

More particularly in accordance with this aspect of the invention, the apparatus comprising a housing having a fixed position output providing a sequential source of sheets and an output tray mounted on the housing adjacent the output for supporting the sheets. A compiler shelf is located on the housing adjacent the output tray, the compiler shelf partially supporting the sheets. A compiling mechanism is mounted on the housing and a stapler is movably mounted on the housing. The stapler is longitudinally reciprocable in relation to the shelf and the compiling mechanism. The stapler and the compiler mechanism are so located in relationship to each other that the stapler has a strictly linear motion along an edge of the sheets.

Preferably the output tray is vertically movable and includes a first end mounted to the housing and a second end spaced from the housing such that the output tray is angled from a horizontal plane with the second end being higher than the first end. It is also desirable to provide a tamping assembly located in the housing.

In the preferred embodiment of the invention, the stapler is secured in a stapling carriage assembly which is mounted on a longitudinally extending rail. Preferably, at least a portion of the back wall of the housing is operatively secured to the stapler carriage and is movable with the stapler carriage or movable in relation to the stapler carriage. In one embodiment, such movement takes place by means of resilient biasing means. In another embodiment, the housing back wall portion is rigidly secured to the stapler carriage. The back wall comprises a U-shaped member facing the output tray so that a bind edge of the sheets is located in the U-shaped member.

One advantage of the present invention is the provision of a new and improved office machine.

Another advantage of the present invention is the provision of a stapler apparatus for a finishing station of an office machine which stapler apparatus has a strictly linear motion.

Still another advantage of the present invention is the provision of an office machine with a stapling carriage assembly which is mounted on at least one longitudinally extending rail.

Yet another advantage of the present invention is the provision of an office machine with a stapling carriage wherein a portion of a back wall of the housing of the office machine is operatively connected to the stapler and is thus movable with the stapler or in relation to the stapler.

A further advantage of the present invention is the provision of an office machine with a compiler architecture that allows sheets to compile directly over a stapler of the office machine.

An additional advantage of the present invention is the provision of an office machine with a single tray uphill tamper compiler architecture that allows a sheet being compiled to be partially supported by the output tray while at the same time enabling a stapler of the office machine to have a strictly linear motion.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, several embodiments of which will be described in detail in this specification and illustrated in the accompanying drawings which form a part hereof and wherein.

DETAILED DESCRIPTION OF THE SEVERAL EMBODIMENTS

Figure 1:
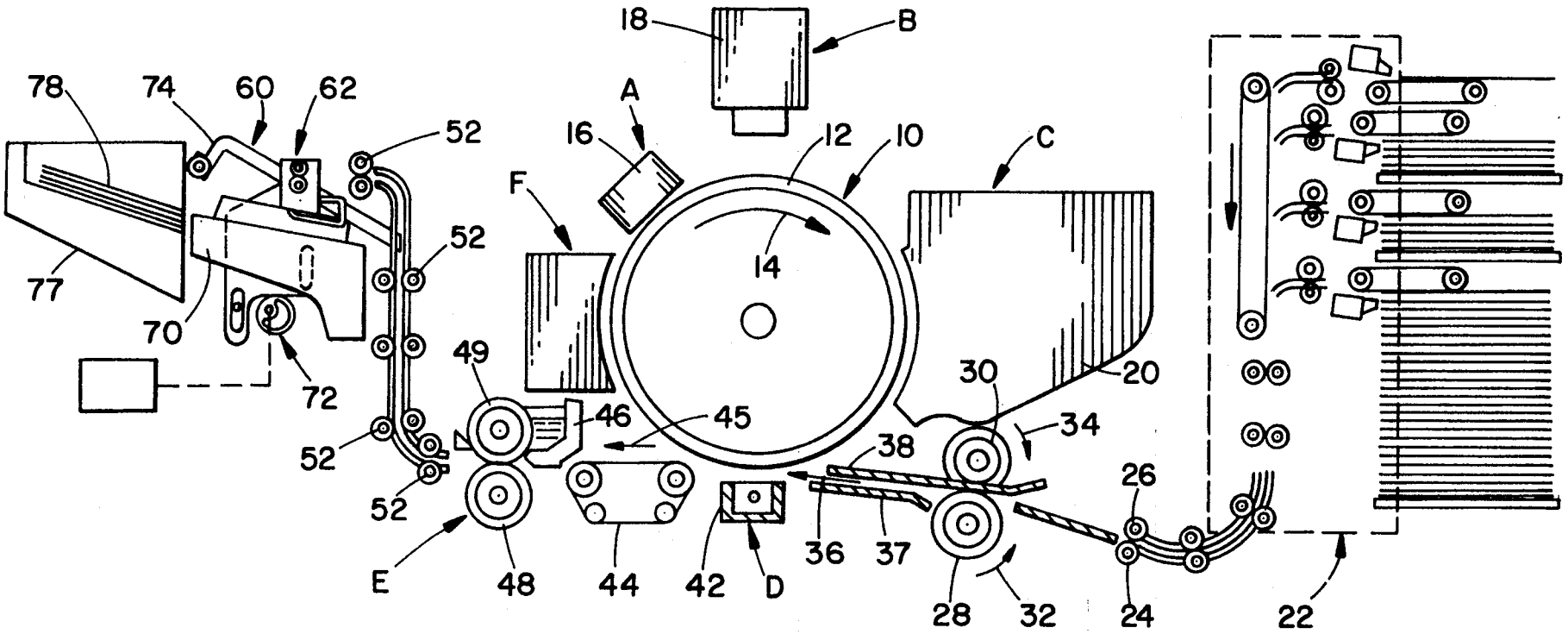
FIG. 1 is a schematic side elevational view depicting an illustrative electrophotographic printing machine incorporating the stapler mechanism of the present invention.

Referring now to the drawings, wherein showings are for purposes of illustrating several embodiments of the invention only and not for purposes of limiting same, FIG. 1 shows an electrophotographic printing machine in which the features of the present invention may be incorporated. For a general understanding of an electrophotographic printing machine, FIG. 1 depicts schematically the various components thereof. Hereinafter, like numerals will be employed throughout to designate identical elements. Although the apparatus for stapling is particularly well adapted for use in connection with electrophotographic printing machines such as the one illustrated in FIG. 1, it should become evident from the following discussion that it is equally well suited in a wide variety of office machines and is not necessarily limited in this application to the particular embodiment shown herein.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 secured to the exterior circumferential surface of a conductive substrate is rotated in the direction of arrow 14. By way of example, photoconductive surface 12 may be made from selenium. A suitable conductive substrate is made from aluminum. Initially, drum 10 rotates a portion of photoconductive surface 12 through a charging station A. The charging station employs a corona generating device indicated generally by reference numeral 16 to charge photoconductive surface 12 to a relatively high, substantially uniform potential.

Thereafter, drum 10 rotates the charged portion of the photoconductive surface 12 to exposure station B. The latter includes an exposure mechanism indicated generally by the reference numeral 18 having a stationary transparent platen such as a glass plate or the like for supporting an original document thereon. Lamps (not illustrated) illuminate the original document. Scanning of the original document is achieved by an oscillating mirror (not illustrated) in a timed relationship with the movement of the drum 10 or by translating the lamps and lens across the original document so as to create incremental light images which are projected through an apertured slit (not illustrated) onto the charged portion of the photoconductive surface 12. Irradiation of the charged portion of the photoconductive surface 12 records an electrostatic latent image corresponding to the informational areas contained within the original document. Obviously, electronic imaging of page image information could be facilitated by a printing apparatus using electrical imaging signals. The printing apparatus can be a digital copier including an input device such as a raster input scanner (RIS) and a printer output device such as a raster output scanner (ROS) or a printer utilizing a printer output device such as an ROS.

Drum 10 rotates the electrostatic latent image recorded on photoconductive surface 12 to development station C. Development station C includes a developer unit indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. The developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on the photoconductive surface 12.

A copy sheet is advanced by sheet feeding apparatus 22 which includes drive rolls 24 and 26 to a registration roller 28 and an idler roller 30. Registration roller 28 is driven by a motor (not shown) in the direction of arrow 32. The idler roller 30 rotates in the direction of arrow 34 since roller 28 is in contact therewith. In operation, the feed device 22 operates to advance the copy sheet from the tray through the guide along the path in which rolls 24 and 26 are located and then into registration rollers 28 and 30 such that the sheet is forwarded toward the drum 12 in synchronism with the image of the drum. The sheet is advanced in the direction of arrow 36 through a chute formed by guides 37 and 38 to a transfer station D.

The transfer station D includes a corona generating device 42 which applies a spray of ions to the back side of the copy sheet. This attracts the toner powder image from the photoconductive surface 12 to the copy sheet. After transfer of the toner powder image to the copy sheet, the sheet is advanced by an endless conveyor belt 44 in the direction of arrow 45 to a fusing station E. The fusing station includes a fuser assembly indicated generally by the reference numeral 46. The fuser assembly 46 includes a fuser roll 48 and a backup roll 49 defining a nip therebetween through which the copy sheet passes. After the fusing process is completed, the copy sheet is advanced by pairs of discharge rollers 52 which may be of the same type as the registration rollers 24 and 26 to a compiling apparatus indicated generally by the numeral 60. The compiling apparatus 60 includes a sheet discharge device, usually in the form of a drive nip assembly indicated generally by the reference numeral 62.

Figure 2:
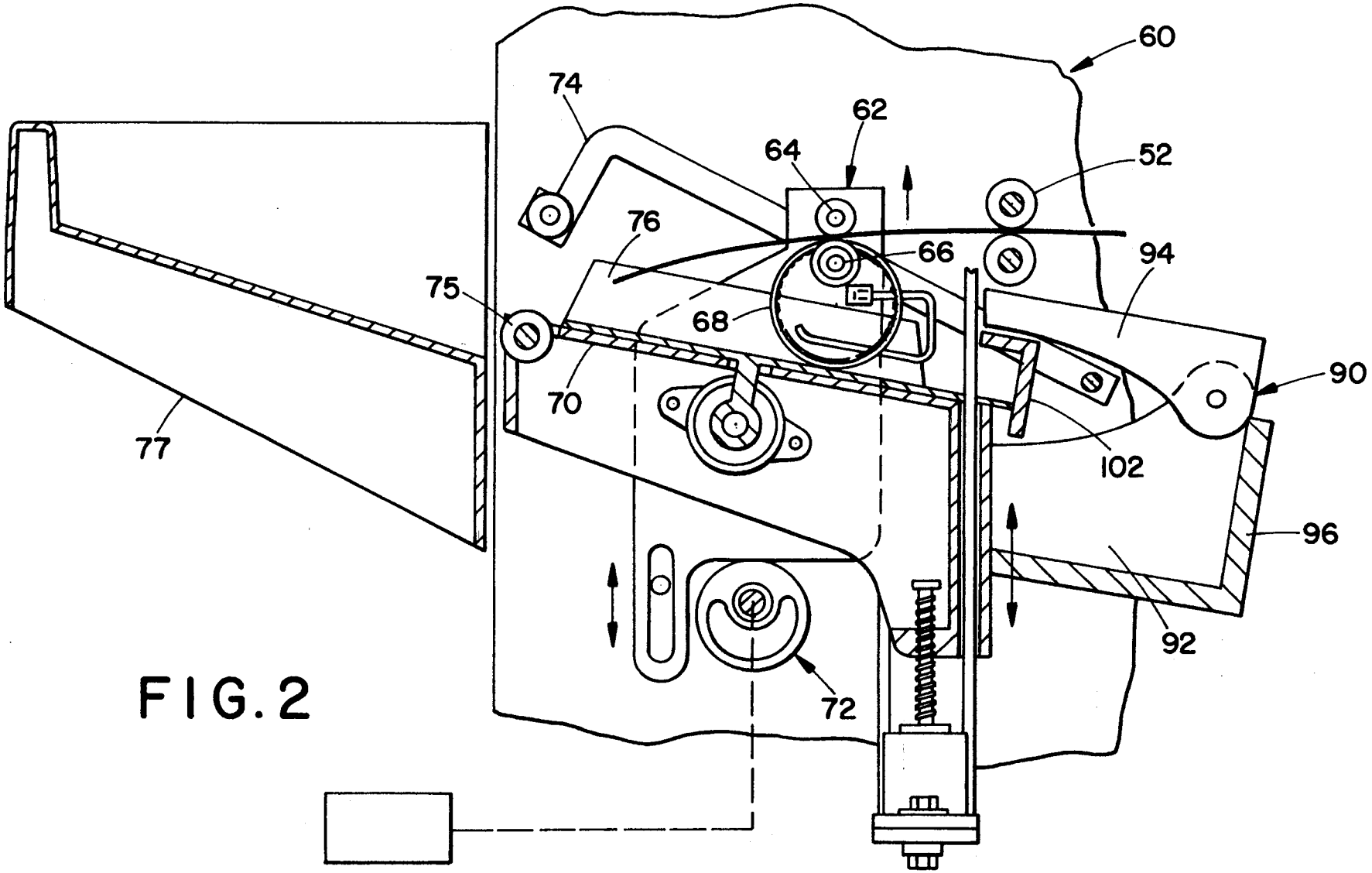
FIG. 2 is an enlarged side elevational view partially in cross section depicting a compiler and stapler apparatus portion of the printing machine of FIG. 1.

This includes an idler 64 and a pulley 66 around which a longitudinal registration belt 68 is partially entrained as can be better seen in FIG. 2. The registration belt 68 is flexible and is advantageous that it provides a top active drive to the sheet being compiled. Therefore, the belt keeps the top sheet at the back registration wall thus providing the potential for very accurate registration. Also, such flexible belts allow the set height to increase (within limits) as sheets are compiled since the belts can easily deflect and still drive the sheets toward the back wall. In addition, the flexible belt has a very low lateral stiffness and therefore can easily deflect out of its plane as the sheets are side tamped by a tamper assembly. Because the belts are always rotating, once the top sheet reaches side registration and stops, the belts "walk" back to the equilibrium position awaiting the next sheet.

The compiling apparatus further comprises a compiling tray 70, a vertical adjustment device 72 for the discharge drive nip assembly 62, a compiled set discharge device 74, including exit drive rolls 75 (see FIG. 2), a tamper assembly 76 (see FIG. 5) and a stacking tray 77 for receipt of the finished attached sheet sets 78. It is noted that both the compiling tray 70 and the stacking tray 77 are "uphill" trays which have one edge, the edge nearest the discharge rollers 52 located at a lower elevation than the far edge.

Invariably, after the copy sheet is separated from the photoconductive surface 12, some residual toner particles remain adhering thereto. These toner particles are removed from the photoconductive surface 12 at a cleaning station F. The cleaning station includes a corona generating device (not shown) adapted to neutralize the remaining electrostatic charge on photoconductive surface 12 and that of the residual toner particles. The neutralized toner particles are then cleaned from the photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 illustrates the compiling apparatus 60 in greater detail.

Figure 4:
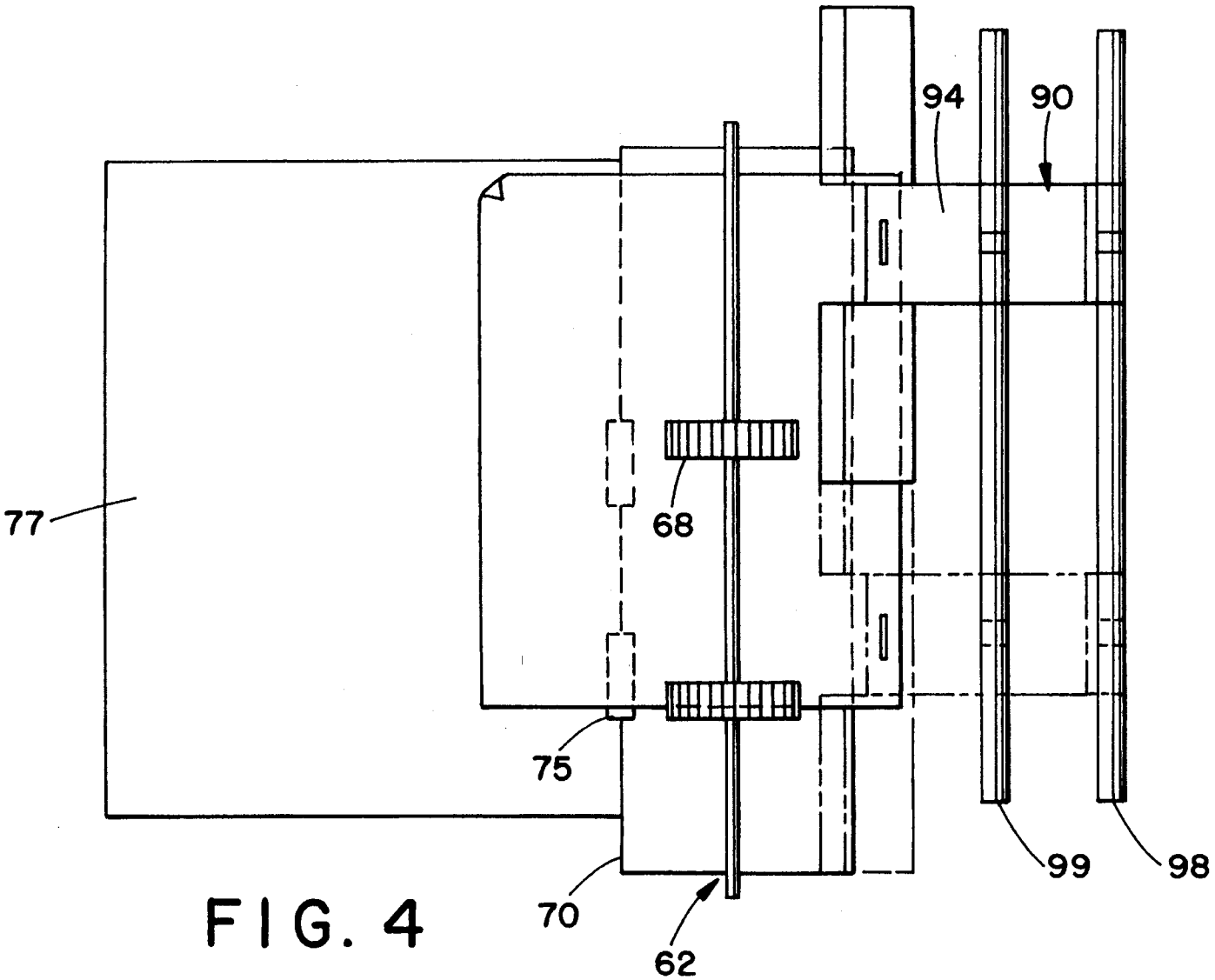
FIG. 4 is a top plan view of the compiler and stapler apparatus of FIG. 2.

The compiling apparatus includes a stapler device 90 comprising a fixed anvil 92 and a movable clinch 94 that are housed in a stapler carriage 96 which can be reciprocated along the length of the compiler mechanism 60 as can perhaps best be seen in FIG. 4 of the drawings since it is mounted on a rail 98 and a shaft 99 journaled on bearings. The rail 98 is U-shaped and captures a wheel (not visible) mounted on the stapler carriage 96. While a rail 98 and shaft 99 are illustrated in FIG. 4, it should be appreciated that the carriage 96 could also be mounted differently, such as on a pair of rails, for example.

Figure 5:
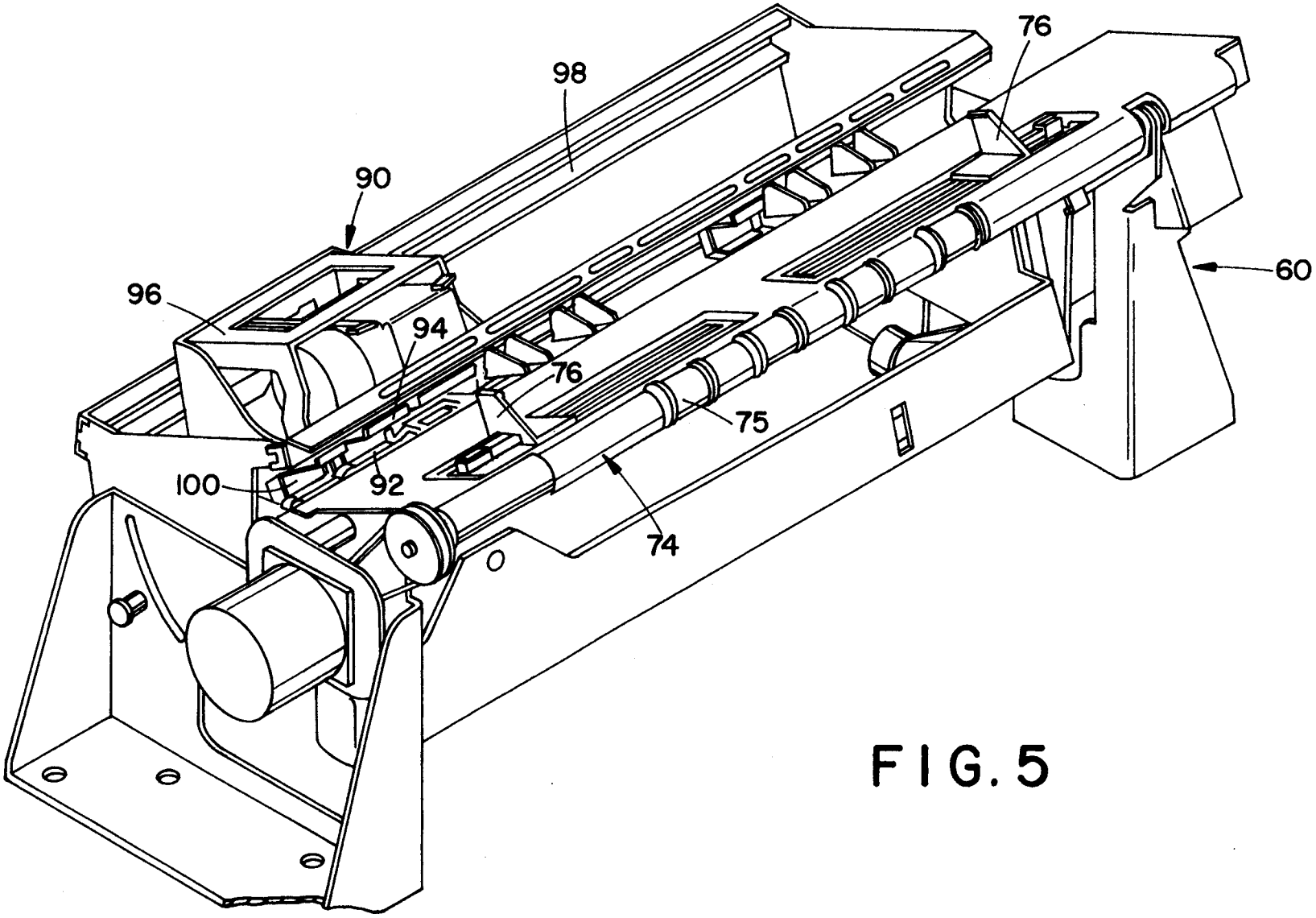
FIG. 5 is a perspective view from a front right side of the compiler and stapler apparatus of FIG. 1.
Figure 6:
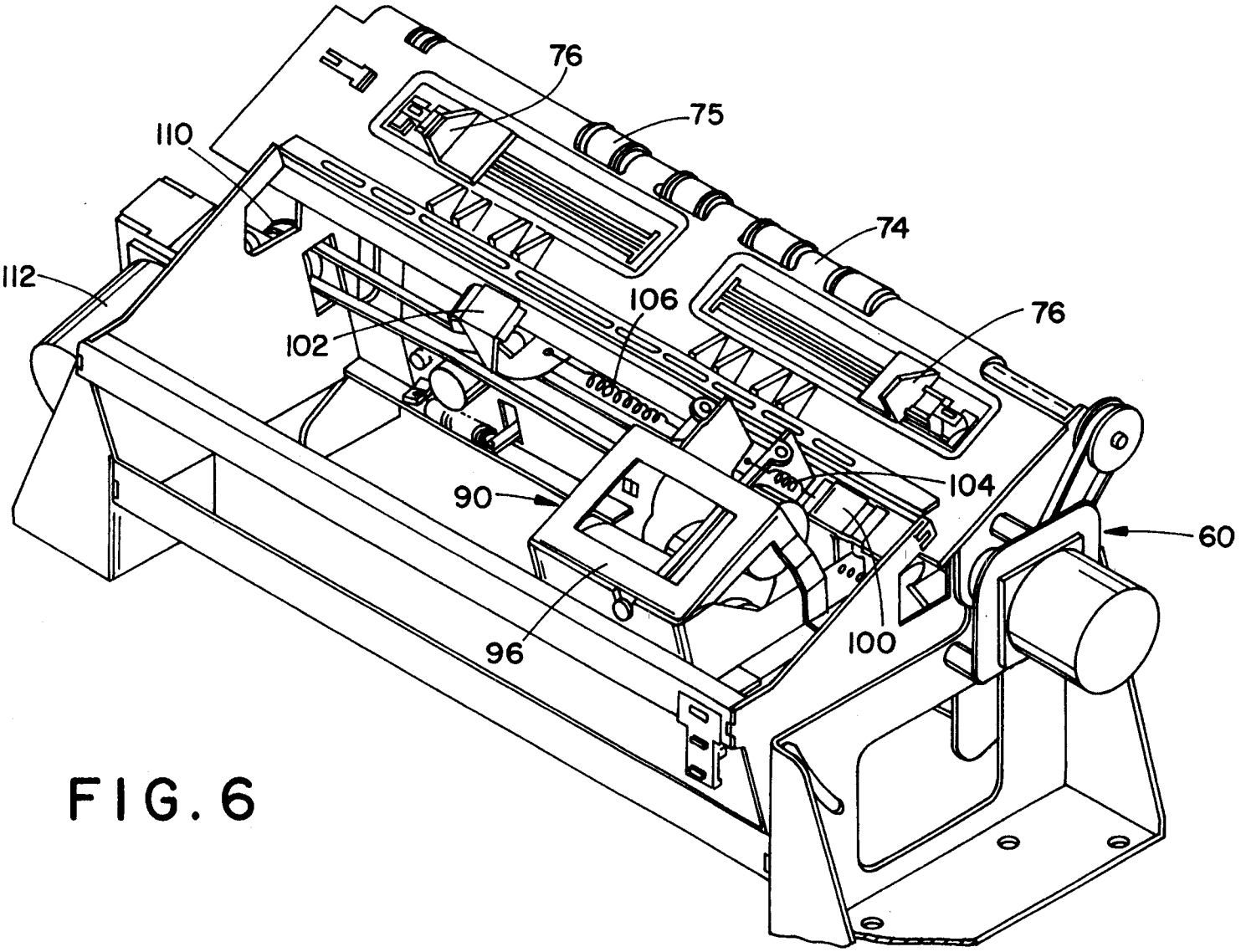
FIG. 6 is a perspective view from a front left side of the compiler and stapler apparatus of FIG. 5.

With reference now also to FIG. 5 which illustrates an actual embodiment of the device, the compiling mechanism 60 includes at least a portion of a back wall of the electrophotographic printing machine. It should be appreciated that the compiling mechanism 60 in FIG. 5 is oriented in a direction which is the mirror image of the right to left process direction of the compiler of FIGS. 14. The back wall comprises a first section 100 and, spaced therefrom a second section 102. Separating the two sections are the anvil and clinch 92, 94 of the stapler device 90. With reference now also to FIG. 6, a first resilient biasing means such as a spring 104 resiliently connects the first back wall section 100 to the stapler carriage 96 and a second resilient biasing means such as a spring 106 resiliently connects the second wall section 102 to the stapler carriage 96. A belt 108 is secured to the carriage 96. Provided on at least one end of the mechanism 60 is a pulley 110 around which the belt is looped. The pulley is powered by a motor 112. This arrangement allows for a reciprocation of the carriage 96 along the length of the compiling mechanism 60 on the rail 98 and the shaft 99.

It is noted that the springs 104 and 106 resiliently bias the back wall sections 100 and 102 in relationship to the stapler carriage 96 as it reciprocates along the length of the compiler mechanism 60. More particularly, the first spring section 104 is shown in a compressed position since the stapler carriage 96 is located close to a right end of the compiler mechanism 60. In contrast, the second spring section 106 is shown in an elongated condition such that it urges the second back wall section 102 towards the stapler carriage 96.

Figure 3:
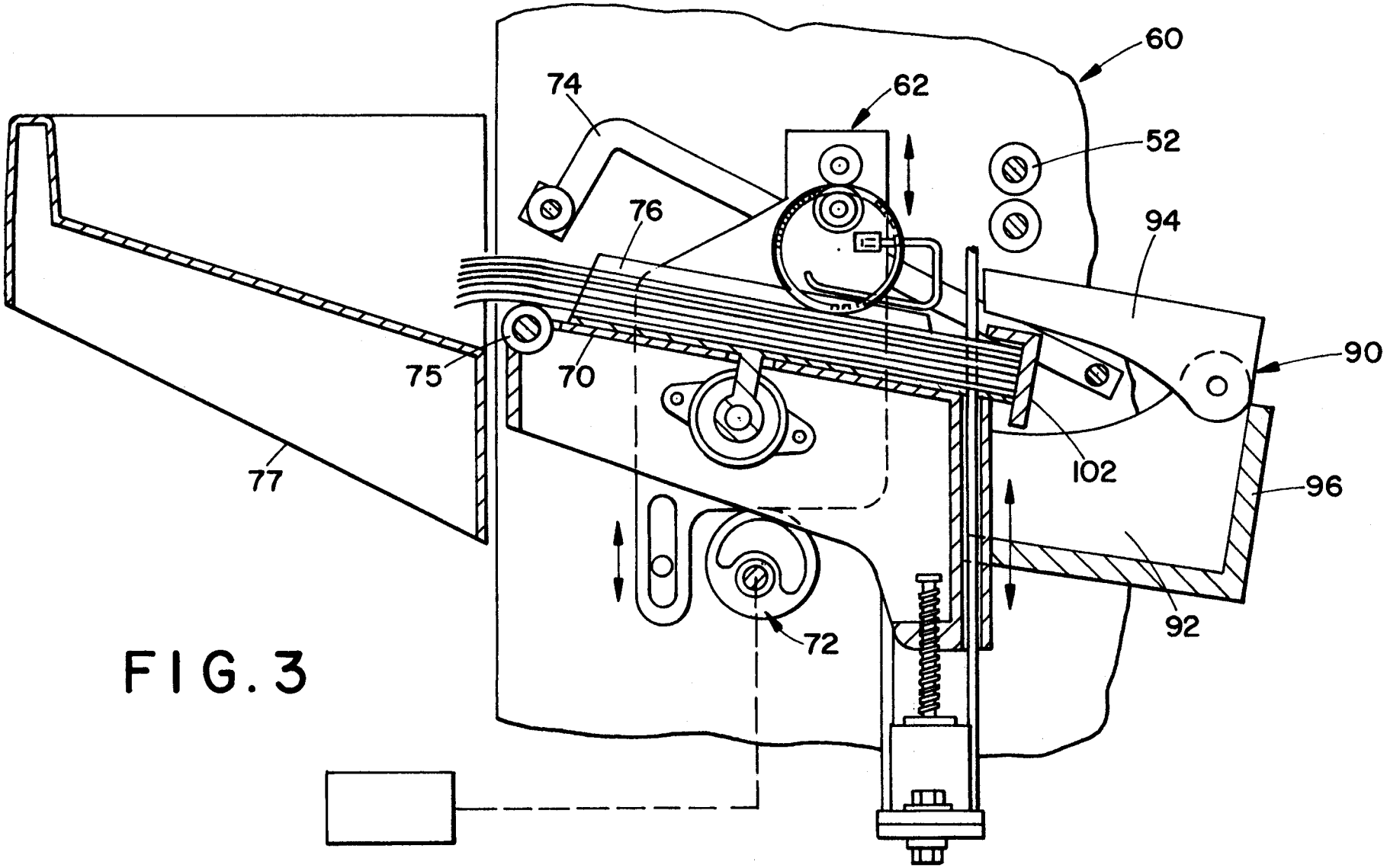
FIG. 3 illustrates the positioning of a plurality of sheets of paper in the compiler and stapler apparatus of FIG. 2.

The somewhat U-shaped channel back wall sections 100 and 102 are necessary for the stability of the sheets which are being stacked at the finishing station illustrated in FIG. 3. The spring bias design illustrated in FIGS. 5 and 6 is advantageous in that it provides a relatively self-contained design with fairly short back walls since the stapler carriage 96 pushes the wall sections 100 and 102 back and forth with the wall sections being spring loaded to a defined position in relationship to the location of the carriage 96.

In relationship to conventional stapler mechanisms located at the finishing station of a copier, the stapler of the present invention is advantageous since the sheets are compiled over the staple head and it is the deep shelf architecture of the current invention which allows one to so compile. In contrast, the prior art devices generally compile to the side of the stapler and then have to move either the sheets to the stapler or the stapler to the sheets for the stapling operation. With the deep shelf architecture illustrated in this invention, one is capable of compiling directly over the staple head and then moving that head as necessary anywhere along the bind edge for the stapling operation. Such movement is accomplished fairly quickly as there is only a linear motion of the stapler carriage 96. In contrast, conventional stapler assemblies even when they are located directly adjacent the sheets being compiled cannot move entirely linearly anywhere along the bind edge. Rather, such mechanisms need to move in and out in order to move around obstructions provided in the back wall of the prior art copier.

It is evident from, e.g. FIGS. 2 and 3 of the drawings that the sheets flow over the stapler mechanism 90 and are delivered to compiling tray 70. Once in the tray, since the tray 70 is an uphill tray which tilted towards the stapler mechanism 90, the bind edge of the sheets winds up contacting the back walls 100, 102 due to the action of the registration belts 68 as explained previously. The sheets are aligned by the tamper assembly 76. Thus, the stapler can perform its stapling function as the sheets are now correctly positioned in relationship to it.

It can be seen that with the current invention, it is possible to drive sheets over the top of a single stapler which sheets can then be stacked on an uphill tray with a deep shelf space such that a portion of each sheet is supported by the compiler of the machine. Thus, the sheets are located in the jaws of the stapler for the stapling operation.

The present invention allows for a low cost multiple stapling capability for an office machine such as an electrophotographic printing machine. In other words, the machine is capable of stapling more efficiently because the stapler can move laterally without any obstruction and can staple at any position along the bind edge of the sheets in the stack. This can perhaps best be seen in FIG. 4 of the drawings. This leads to the benefit that either a smaller motor can be used as the motor for moving the stapler or one can provide faster stapling for the office machine. As the bind edge is always against the back wall, the stapler can staple in the left corner in the portrait mode, at either corner of the bind edge as may be necessary in the autolandscape mode (this is determined by a suitable known algorithm in a chip in the copier), or anywhere along the bind edge.

In relationship to the conventional office machine designs of this sort, the present invention provides a deeper compiler shelf by using a U-shaped channel as the back wall. It is evident that this U-shaped channel can move with the stapler carriage if desired. The additional compiler shelf depth which is provided by the present invention can be on the order of 30 to 40 mm 1.18"–1.57" inches). More particularly, an old compiler shelf length can be on the order of 87 mm (3.4 inches) whereas the deeper compiler shelf length provided by the current invention can be on the order of 114 mm (4.48 inches).

Figure 7:
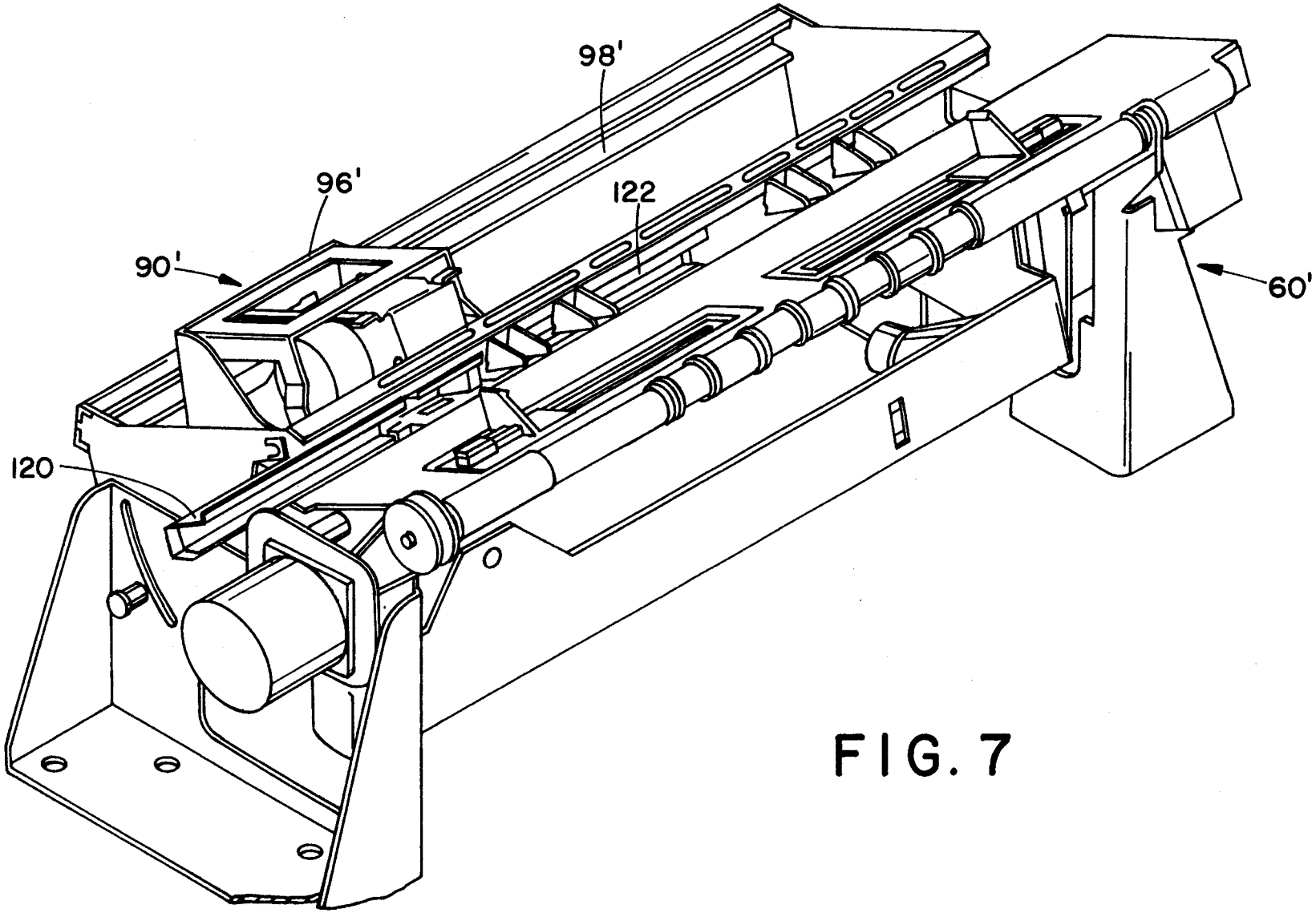
FIG. 7 is a perspective view from a front right side of a second version of the compiler and stapler apparatus according to the present invention.

With reference now to FIG. 7, an alternate embodiment of the present invention is there illustrated. For ease of illustration and appreciation of this alternative, like components are identified by like numerals with a primed suffix (') and new components are identified by new numerals.

In this alternative, the compiling mechanism 60' includes a stapler mechanism 90' having a reciprocating stapler carriage 96'. Fixedly secured to one side of the stapler carriage is a first back wall section 120. Fixedly secured on the other side of the stapler carriage 96' is a second back wall section 122. In this embodiment, the back wall sections reciprocate along with the stapler carriage 96' as the carriage moves back and forth along the length of the compiler mechanism 60' on rails 98'. It is evident from FIG. 7 that the back wall section 120 extends past the side walls of the compiling mechanism 60'. This may be disadvantageous in certain environments where the electrophotographic printing machine is not provided with much side room as the wall section 120 may then contact a wall of the room in which the electrophotographic printing machine is located or jut into the way of personnel using the machine.

Figure 8:
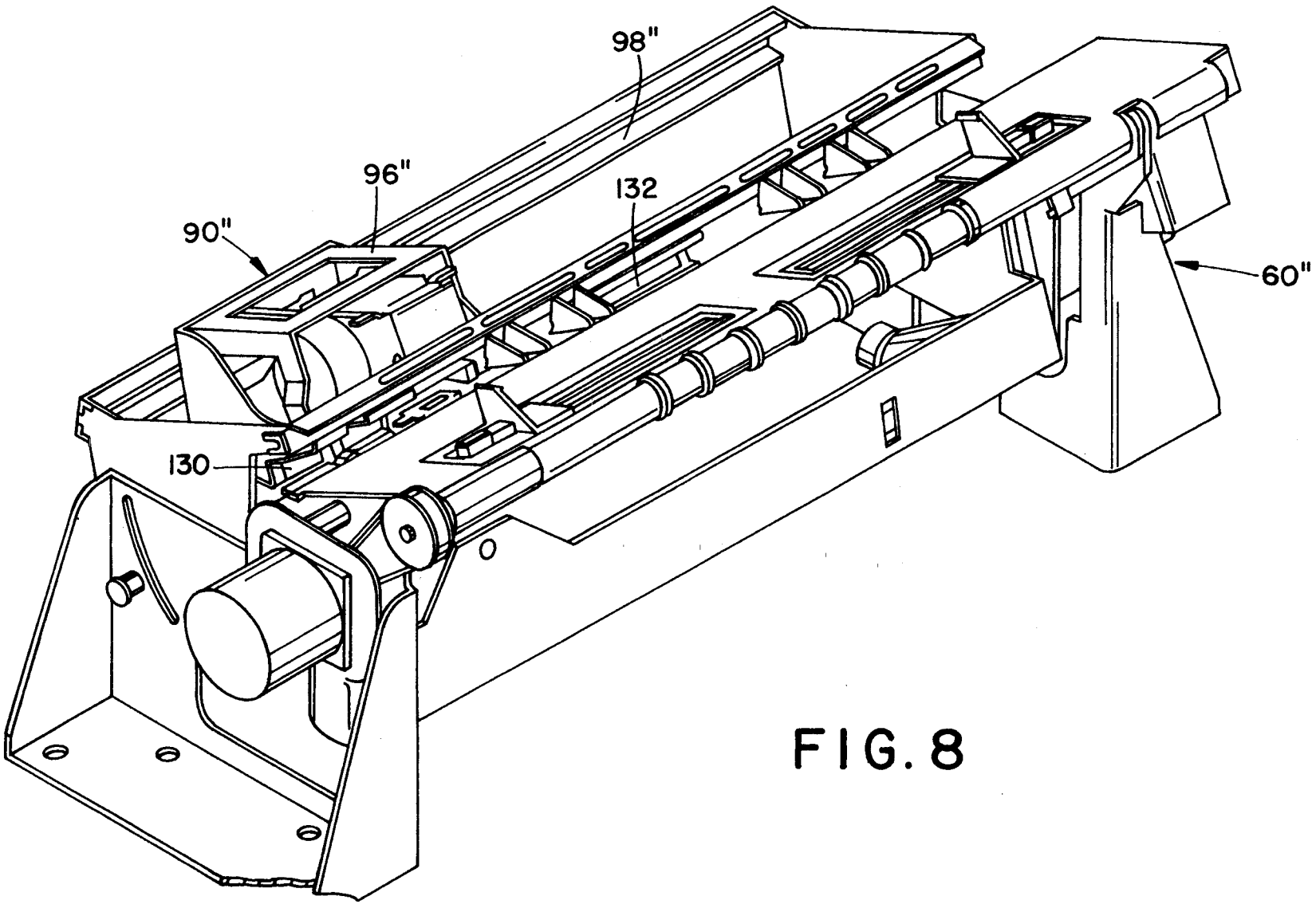
FIG. 8 is a perspective view from the front right side of a third version of the compiler and stapler apparatus according to the present invention.

With reference now to FIG. 8, another embodiment of the present invention is there illustrated. For ease of understanding and appreciation of this alternative of the present invention, like components are identified by like numerals with a double primed (") suffix and new components are identified by new numerals.

This embodiment is a combination of the embodiments illustrated previously in FIGS. 5–6 and 7. More particularly, in this embodiment a compiler mechanism 60" is provided with a stapler device 90" including a stapler carriage 96" which reciprocates along the length of the compiler mechanism on rails 98". Resiliently biased in relationship to a first side of the stapler carriage 96" is a first back wall section 130 by means of a spring (not illustrated in this figure but like the springs illustrated in FIG. 6) so as to maintain a preferred distance for the first back wall section 130 in relationship to the stapler carriage 96". Rigidly secured to another side of the stapler carriage 96" is a second back wall section 132. This back wall section moves with the stapler carriage 96". In contrast, the first back wall section 130 only moves as dictated by the resilient biasing means which connects it to the stapler carriage 96".

Figure 9:
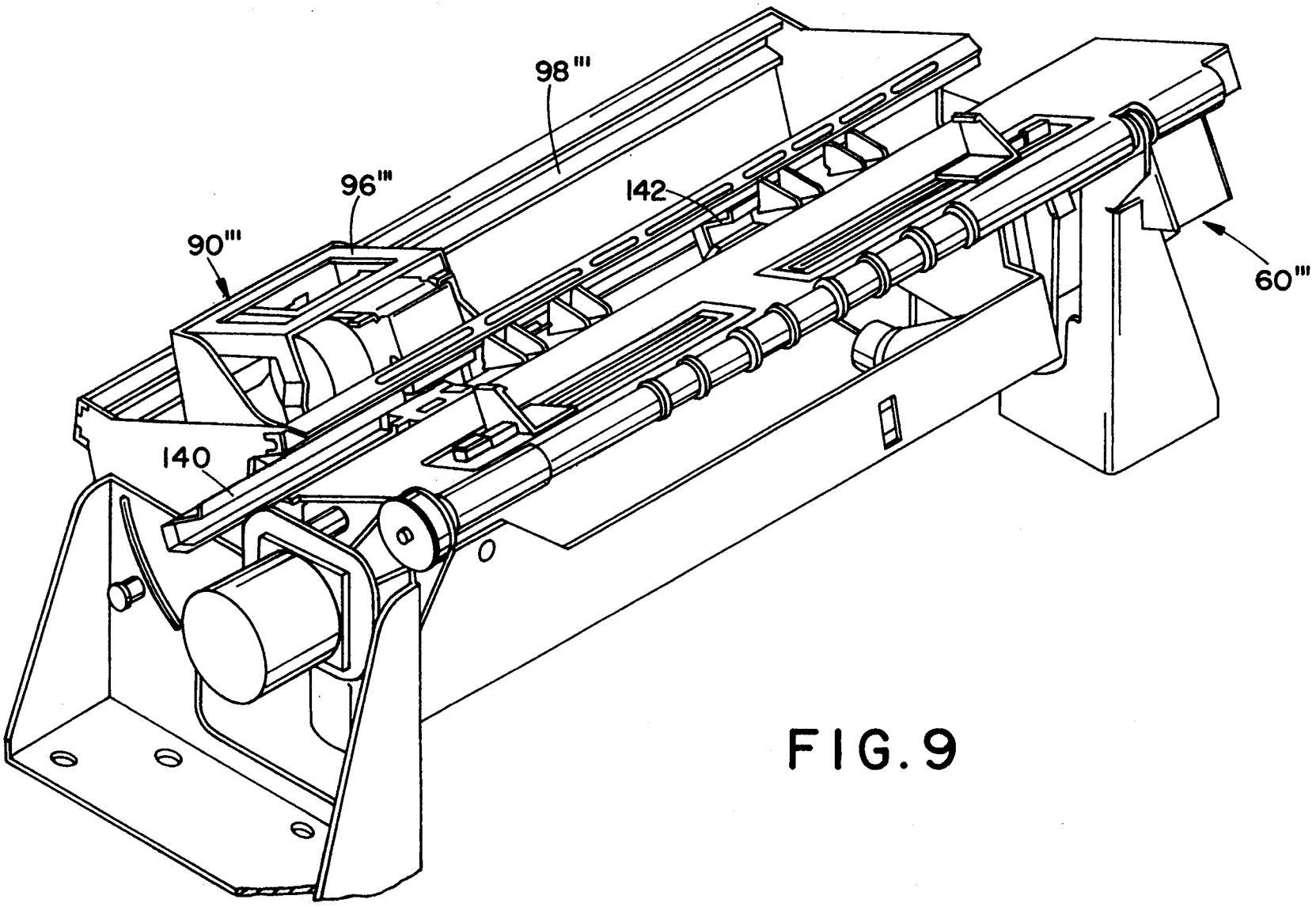
FIG. 9 is a perspective view from the front right side of a fourth version of the compiler and stapler apparatus according to the present invention.

Finally, with reference now to FIG. 9, yet another embodiment of the present invention is there illustrated. For ease of illustration and understanding of this alternative, like components are identified by like numerals with a triple primed (''') suffix and new components are identified by new numerals.

In this embodiment, a compiler member 60''' is provided with a stapler device 90''' including a stapler carriage 96''' which can reciprocate along the length of the compiler 60''' on rails 98'''. Fixedly secured to one side of the stapler carriage 96''' is a first back wall section 140. Resiliently secured to a second side of the stapler carriage 96''' is a second back wall section 142. The second back wall section is secured by means of a resilient biasing member such as the spring illustrated in FIG. 6 of the drawings. That spring is not visible in this figure. It can be seen that FIG. 9 is the obverse of FIG. 8. That is, the opposite back wall member is fixedly secured and the other back wall member is resiliently biased and moves in relationship to the stapler carriage 96''' as compared to FIG. 8.

The invention has been described with reference to several embodiments. Obviously, modifications and alterations will occur to others upon a reading and understanding of this specification. It is intended to include all such modifications and alterations insofar as they come within the scope of the appended claims or the equivalents thereof.

We claim:

1. A sheet stacking, registration and set fastening system for stacking, registering and fastening stacked sets of plural printed sheets fed from a reproduction apparatus onto a stacking area of a defined area stacking tray, comprising:

a vertically extending laterally movable sheet stacking edge registration system adjacent at least one edge of said stacking tray for edge registering sheets stacked in said stacking tray in an edge registration area;

a set fastening system laterally movable parallel to said edge registration area of said stacking tray to fasten a stack of sheets edge registered in said stacking tray in plural different fastening positions;

said sheet stacking edge registration system having plural movable components providing access therethrough to said stacking tray by said set fastening system;

said set fastening system continuously extending into said stacking area of said stacking tray through said edge registration system for said plural different fastening positions;

said sheet stacking edge registration system being automatically movable in coordination with said movement of said set fastening system to not obstruct said set fastening system for said plural different fastening positions yet maintain registration of a stack of sheets in said stacking tray stacking area at said edge registration area thereof with at least a portion of said plural components of said registration system.

2. The sheet stacking, registration and set fastening system of claim 1, wherein said set fastening system comprises a stapler head with stapling jaws extending into said stacking area which moves in a simple linear path parallel to but inside of said edge registration area.

3. The sheet stacking, registration and set fastening system of claim 1, wherein both said edge registration system and said movable set fastening system are outside of said stacking tray and said defined stacking area and said edge registration area extends slightly beyond one edge of said stacking tray so that said stacking tray cannot interfere with movement of said set fastening system.

4. The sheet stacking, registration and set fastening system of claim 1, wherein said edge registration system comprises a pair of resiliently biased wall backstop members, a respective backstop member extending on a respective side of said set fastening system, wherein said backstop members are movable with said set fastening system.

5. The sheet stacking, registration and set fastening system of claim 1, wherein parts of said edge registration system are attached to opposite sides of said set fastening system.

6. The sheet stacking, registration and set fastening system of claim 5, wherein said parts of said edge registration system are positioned close enough to said set fastening system to maintain a registration of a stacked set of even relatively small sheets.

7. The sheet stacking, registration and set fastening system of claim 1, wherein said stacking tray is vertically movable and includes a first end mounted to said housing and a second end spaced from said housing and wherein said stacking tray is angled from a horizontal plane such that said second end is higher than said first end.

8. The sheet stacking, registration and set fastening system of claim 1, wherein said sheet stacking edge registration system comprises a U-shaped member facing said stacking tray so that a bind edge of the sheets is located in said U-shaped member.

9. A compiling and stapling apparatus for sheets fed from an output providing a sequential source of sheets, comprising:

a compiler shelf located on said housing adjacent said output tray, said compiler shelf partially supporting said sheets;

a stapler movably mounted on said housing, said stapler being longitudinally reciprocable in relation to said compiler shelf; and, a back wall of said housing, said back wall being operatively secured to said stapler so that it is movable with said stapler.

10. The apparatus of claim 9, wherein said stapler is secured in a stapling carriage assembly mounted on a longitudinally extending rail.

11. The apparatus of claim 9, wherein said back wall comprises a pair of sections, one located on each side of said stapler, wherein said sections are sufficiently close to said stapler to maintain a registration of a stacked set of even relatively small sheets.

12. The apparatus of claim 11 further comprising resilient biasing means for urging said sections to a predetermined distance in relation to said stapler.

13. The apparatus of claim 12 wherein said resilient biasing means comprises a pair of springs, a respective one of which is located between said stapler and a respective one of said sections.

14. The apparatus of claim 9, wherein said back wall comprises a U-shaped member facing said output tray so that a bind edge of the sheets is located in said U-shaped member.

15. A compiler apparatus for a copier having a single tray uphill compiler architecture, comprising:

a housing having an output for providing a sequential source of sheets;

a compiler shelf located on said housing, said compiler shelf partially supporting the sheets;

a compiling mechanism mounted on said housing;

a stapler movably mounted on said housing, said stapler being longitudinally reciprocable in relation to said compiler shelf; and, a back wall of said housing, said back wall being operatively secured to said stapler so that it is movable with said stapler, wherein said stapler and said compiler mechanism are so located in relationship to each other that said stapler has a strictly linear motion along a bind edge of the sheets.

16. The apparatus of claim 15 wherein said stapler is secured in a stapling carriage assembly to which said back wall is operatively secured.

17. The apparatus of claim 15 wherein said stapler comprises:

an anvil located below said compiler shelf; and, a clinch located above said compiler shelf, wherein said anvil is fixed to prevent movement in a vertical direction and said clinch is movable in the vertical direction.

18. The apparatus of claim 15 wherein said stapler and said back wall are located away from said compiler shelf so that said compiler shelf cannot interfere with a movement of said stapler and said back wall.

19. The apparatus of claim 15 wherein said compiler shelf includes a first end mounted to said housing and a second end spaced away from said housing and wherein said compiler shelf is angled from a horizontal plane such that said second end is higher than said first end.

20. The apparatus of claim 15 wherein said back wall comprises a pair of U-shaped members facing said output tray, a respective U-shaped member being located on a respective side of said stapler, so that a bind edge of the sheets is positioned in said pair of U-shaped members.

* * * * *